US006211842B1

(12) United States Patent
Cousin et al.

(10) Patent No.: US 6,211,842 B1
(45) Date of Patent: Apr. 3, 2001

(54) ANTENNA WITH CONTINUOUS REFLECTOR FOR MULTIPLE RECEPTION OF SATELITE BEAMS

(75) Inventors: Pascal Cousin, La Turbie; Jean-Louis Desvilles, Nice; Jean-Pierre Blot, La Turbie; Jean-Jacques Delmas, Meudon, all of (FR)

(73) Assignees: France Telecom; TéléDiffusion de France, both of Paris (FR)

( * ) Notice: Subject to any disclaimer, the term of this patent is extended or adjusted under 35 U.S.C. 154(b) by 0 days.

(21) Appl. No.: 09/561,219

(22) Filed: Apr. 28, 2000

(30) Foreign Application Priority Data

Apr. 30, 1999 (FR) ..... 99 05556

(51) Int. Cl.[7] ..... H01Q 19/12

(52) U.S. Cl. ..... 343/840; 343/755; 343/786; 343/914

(58) Field of Search ..... 343/753, 754, 343/755, 781 R, 781 P, 781 CA, 786, 835, 836, 837, 912, 914, 840; H01Q 19/12, 19/17

(56) References Cited

U.S. PATENT DOCUMENTS

| | | | | |
|---|---|---|---|---|
| 4,203,105 | * | 5/1980 | Dragone et al. | 343/781 P |
| 4,755,826 | * | 7/1988 | Rao | 343/781 P |
| 5,140,337 | | 8/1992 | Rappaport . | |
| 5,175,562 | | 12/1992 | Rappaport . | |
| 5,214,540 | * | 5/1993 | Yakimovsky | 359/858 |
| 5,283,591 | | 2/1994 | Delmas . | |
| 6,084,552 | * | 7/2000 | Robertson et al. | 343/753 |

FOREIGN PATENT DOCUMENTS

| | | |
|---|---|---|
| 0 700 118 A1 | 3/1996 | (EP) . |
| 2 701 169 | 8/1994 | (FR) . |

OTHER PUBLICATIONS

William P. Craig, Carey M. Rappaport and Jeffrey S. Mason entitled "A High Aperture Efficiency, Wide–Angle Scanning Offset Reflector Antenna", IEEE Transactions on Antennas and Propagation, vol. 41, No. 11, Nov. 1993, pp. 1481–1490.

Bergmann Jr. and Hasselmann FJV entitield "On the implementation of global interpolating functions for shaped reflector antennas". Eighth International Conference on Antennas and Propagation, vol. 1, Mar. 30, 1993—Apr. 2, 1993, pp. 84–87, xp002127310, Edinbugh, GB.

Bergmann Jr. et al, entitled: "A comparison between techniques for global surface interpolation in shaped reflector analysis", IEEEE Transactions on Antennas and Propagation, vol. 42, No. 1, Jan. 1994, pp. 47–53, XP002127311, New York, USA.

Blot JP et al., entitled "Antenne torique pour reception multisatellites en bande Ku", Nov. 13–15, 1990, pp. 197–200, XP002127312, Nice, France.

* cited by examiner

*Primary Examiner*—Tho Phan
(74) *Attorney, Agent, or Firm*—Laubscher & Laubscher

(57) ABSTRACT

An antenna receives beams from telecommunication satellites in geostationary orbit close to the equator. The continuous concave reflecting surface of the reflector of the antenna has an equation deduced from a paraboloid by adding thereto the equation of a correction surface comprising a second order polynomial and a sum of N(2N–1) terms depending on distances between the projection of any point on the reflecting surface and N(2N–1) control points of a grid extending over a plane perpendicular to the plane of symmetry. The angular separation of the primary sources on a circular support with an inclination different from the angle of offset is less than approximately 3° for an aperture of more than 50°.

17 Claims, 6 Drawing Sheets

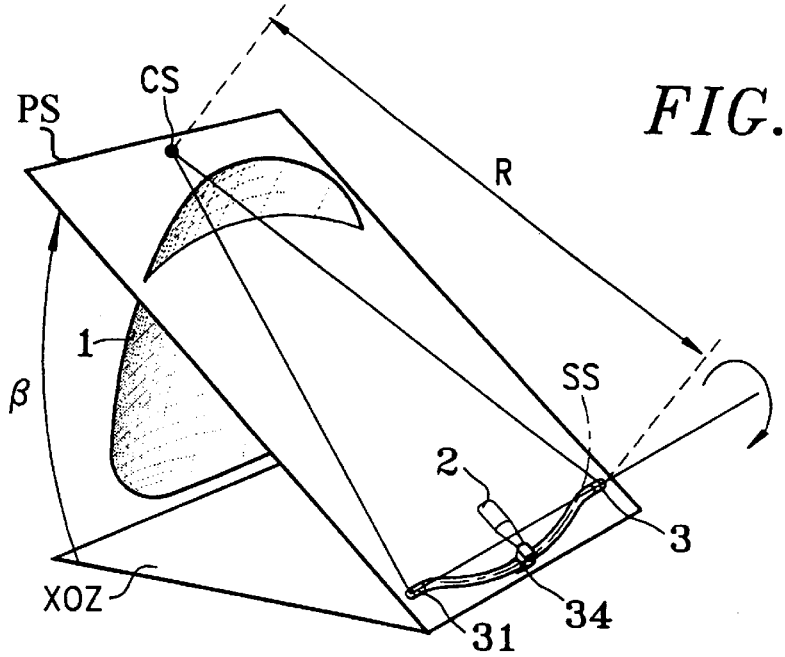
FIG. 11
FIG. 12
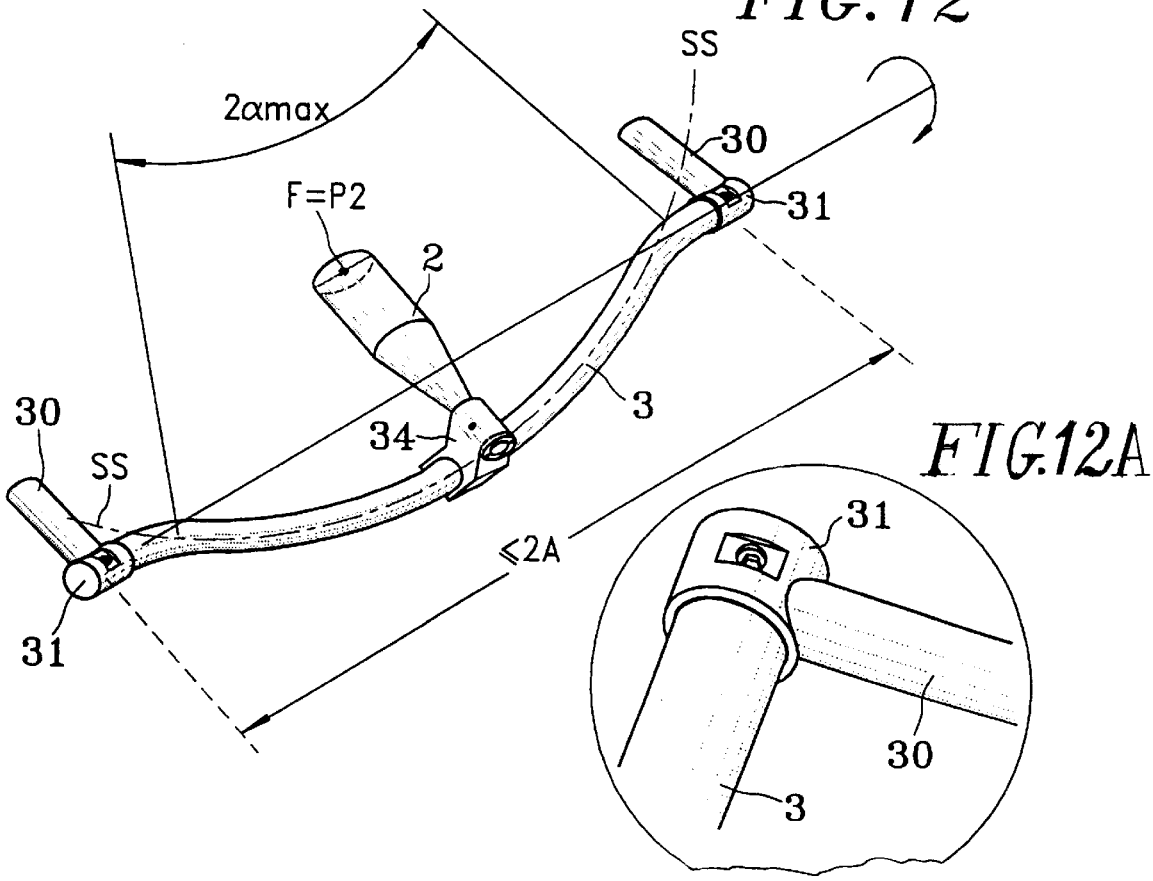
FIG.12A

ANTENNA WITH CONTINUOUS REFLECTOR FOR MULTIPLE RECEPTION OF SATELITE BEAMS

BACKGROUND OF THE INVENTION

1. Field of the Invention

The present invention relates to an antenna for receiving or even transmitting telecommunication satellite beams.

The invention relates more particularly to an antenna with a single reflector having a wide field of view for receiving simultaneously a plurality of beams from geostationary broadcast satellites depointed by approximately 50° from each other without using a motorized means for moving the reflector. The antenna is intended in particular for domestic installations in private houses, collective installations in buildings or community installations feeding cable network head ends for receiving a plurality of beams transmitted by radiocommunication satellites.

The antenna of the invention can also be used for professional applications such as data broadcast networks.

2. Description of the Prior Art

The individual satellite-beam receiving antenna for consumer use that is currently most widely used comprises a fixed reflector whose reflecting surface is a paraboloid of revolution which is circular with a diameter, or elliptical with major axis, from 50 cm to 90 cm. The axis of symmetry of the reflector is pointed toward the satellite. A receiver head is generally fixed by arms and positioned at the single focus of the reflector.

If the target satellite has an orbital position very close to other geostationary satellites, the antenna picks up the emissions from the various satellites by means of one or two receiver heads. However, if the user wishes to receive a plurality beams of satellites depointed by more than approximately 10° the reflector must be turned and directed toward the chosen satellite either manually or by means of a motor. Thus this reflector type antenna cannot receive simultaneously from a plurality of satellites.

The antennas generally used for multisatellite reception have a reflector in the form of a parabolic or spherical torus. This type of reflector has a low efficiency, of 24% at most, because only a small part of the reflector is illuminated in any given direction. Consequently, the scanning capacities of a receiver primary source in front of this reflector can be increased only at the cost of a considerable increase in the surface area of the reflector.

U.S. Pat. No. 5,140,337 describes an antenna reflector with a high aperture efficiency which has a substantially cylindrical concave reflecting surface whose cross sections are deduced from two identical parabolas with axes tilted symmetrically relative to an azimuth plane. The article by William P. Craig, Carey M. Rappaport and Jeffrey S. Mason entitled "A High Aperture Efficiency, Wide-Angle Scanning Offset Reflector Antenna", IEEE Transactions on Antennas and Propagation, Vol. 41, No. 11, November 1993, pages 1481–1490, also concerns a reflecting surface of reflectors derived from two tilted and symmetrical parabolas, but in this case forming the section of a torus. U.S. Pat. No. 5,175,562 from the same inventor, Carey M. Rappaport, discloses an offset antenna of high efficiency ensuring a wide field of view, from −30° to +30°; the concave reflecting surface of the reflector of the antenna is deduced from two identical paraboloids with axes tilted symmetrically relative to the aiming axis of the antenna and is defined by a sixth order polynomial equation.

However, the geometry of the above reflectors is not satisfactory for individual reception because the focal length of these reflectors is too long. They require extremely directional receiver primary sources of large diameter, so increasing the overall size of the antenna, and the angular separation of radiation between consecutive beams is greater than 6°.

European patent application No. 0,700,118 discloses a continuous concave reflector reflecting surface which is deduced from a portion of a predetermined paraboloid by linear variation of the level of a point parallel to the axis of the paraboloid as a function of the wavelength.

This reflecting surface in practice produces relatively low gains for radiation directions depointed a few tens of degrees relative to the focus of the paraboloid.

OBJECTS OF THE INVENTION

The main object of the invention is to provide a fixed antenna reflector with reflecting surface which is deduced from a single paraboloid by an optimum equation formulation algorithm in order to receive simultaneously a plurality of beams from satellites strongly depointed relative to each other using a plurality of primary sources positioned in a wide aperture of the order of 50° with stable directivity and relatively low angular separation, of the order of a few degrees, and therefore greater aperture efficiency, of the order of 40% to 50%, than the prior art reflectors referred to above.

Another object of this invention is to optimize the reflecting surface of the antenna reflector thereby improving the average efficiency over the entire field of view of the antenna, without generating highly asymmetrical secondary lobes when the beams track the geostationary orbit.

SUMMARY OF THE INVENTION

The invention concerns, as the above european patent application No. 0,700,118, an antenna comprising a reflector for telecommunication satellite beams having a continuous concave reflecting surface whose equation is deduced from the equation of an offset paraboloid having a focus and an offset angle by adding thereto the equation of a correction surface and which is symmetrical about a focal plane of symmetry of the paraboloid. According to the above objects, the equation of the correction surface comprises a second order polynomial in two coordinates relative to axes perpendicular to the axis of symmetry of the paraboloid and a sum of N(2N−1) terms depending in particular on distances between the projection of any point on the reflecting surface onto a plane perpendicular to the focal plane of symmetry and N(2N−1) control points of a grid extending over said perpendicular plane and limited by the focal plane of symmetry, where N is an integer not less than 2.

As we will see in the detailed description, most terms of the equation of the correction surface have a coefficient depending on the focal distance between the paraboloid focus and the center of the reflecting surface and a dimensionless parameter which is a function of the field of view of the reflector. The value of the dimensionless parameter, of the order of 0.55, enables to adjust the field of view.

According to a prefered embodiment of the invention, the equation of the correcting surface is:

$$z_c(x, y) = \sum_{i=1}^{i=l} \frac{a_i}{(\gamma \cdot f')^4}[r_i(x, y)]^5 + \frac{b_1}{(\gamma \cdot f')}x^2 + \frac{b_2}{(\gamma \cdot f')}y^2 + b_3 y + b_4 \cdot \gamma \cdot f'$$

with $$r_i(x,y)=[(y-\gamma \cdot f' \cdot y_i)^2+(x-\gamma \cdot f' \cdot x_i)^2+(x+\gamma \cdot f' \cdot x_i)^2]^{1/2}$$

where x, y and z are coordinates of any point on the reflecting surface and $x_i$, $y_i$ are coordinates of a control point of the grid in said perpendicular plane, $a_i$ and $b_1$ to $b_4$ are predetermined coefficients, γ is the dimensionless parameter, and f' is the focal distance between the focus of the paraboloid and the center of the reflecting surface.

For latitudes of the antenna from 30° to 60°, it is preferred that the focal distance between the focus of the paraboloid and the center of the reflecting surface lies between 30 times and 45 times an average wavelength of said satellite beams, i.e. approximately 0.75 m to 1.1 m in the Ku band for a central frequency around 12 GHz, and the offset angle between the axis of the paraboloid and the segment joining the focus to the center of the reflecting surface lies between about 20° and about 30°.

In practice, the antenna is of the offset type and the contour of the reflector is generally substantially circular, elliptical or rectangular and the antenna fits within a meter cube.

Another object of the invention is to provide a primary source support of relatively simple and therefore inexpensive design and assuring easy and accurate pointing of the primary sources by reflection from the reflector towards satellites in geostationary orbit, which is not rectilinear in non-equatorial regions.

The support supports primary sources oriented toward the center of the reflecting surface. The support can have a circular arc shape, preferably within an angle of about 50°. The support does not include the focus of the paraboloid, and lies in a support plane and is positioned so that a source in the focal plane of symmetry has a phase center coinciding substantially with the paraboloid focus. The support plane has an inclination to the axis of the paraboloid greater than the offset angle between the axis of the paraboloid and a segment joining the paraboloid focus to the center of the reflecting surface. This inclination adjusts the position of the support and thus that of the sources as a function of the latitude of the antenna. In particular, the inclination of the support plane depends on a logarithmic function of the offset angle and a linear function of the latitude of the antenna. The difference between the inclination of the support plane and the offset angle is from approximately 10° to approximately 20° for an antenna latitude between 30° and 60°.

The support can have a radius which is proportional to the focal distance between the focus of the paraboloid and the center of the reflecting surface and which depends on a trigonometric function of the inclination of the support plane and the offset angle.

The support can be mounted to rotate about an axis fixed relative to the reflector and passing through the ends of the support and perpendicular to the focal plane of the paraboloid containing the center of the reflector in order to select accurately the inclination of the support plane.

At present there is no multibeam antenna which does not require adjustment of pointing of the sources as a function of the latitude of the station. The aforementioned features of the support according to the invention, and in particular the chosen radius and the orientation of the support, eliminate all adjustments transversely to the lateral displacement of the sources. This significantly improves the ergonomics of the antenna mounting by simplifying pointing the beams at the geostationary orbit. Accordingly, and in contrast to the prior art, the reflector type antenna according to the invention minimizes errors in pointing the beams toward the geostationary orbit regardless of the latitude at which the antenna is installed.

The invention concerns also at least two primary sources having an angular radiation separation not greater than approximately 3° in order to pick up beams from satellites that are very close with no significant interference between them, which contributes to achieving excellent reception coverage over an angular range greater than 50°.

According to a first embodiment, at least one horn primary source having a cylindrical rear section, a frustoconical intermediate section whose larger base diameter is substantially less than twice the average diameter of the rear section, and a frustoconical front section whose length is substantially greater than twice the length of the intermediate section and has a larger base diameter is substantially equal to twice the average diameter of the rear section.

The directivity of the horn primary source is improved when it comprises a horn primary source which has a facial groove situated at the periphery of the larger base of the frustoconical front section having a width substantially equal to ⅛ the diameter of the larger base of the front section and delimited by an outside edge longer than the inside edge of the groove.

According to a second embodiment, at least one dielectric candle primary source. This dielectric candle source can comprise a dielectric candle having first, second and third cylindrical sections of substantially identical length and diameters decreasing from one section to the next from a rear end toward a front end of the dielectric candle source in ratios from approximately ¾ to approximately 9/16 and from approximately ½ to approximately ⅔. In another embodiment, the dielectric candle source can comprise a dielectric candle having a cylindrical first section, second and third sections having lengths substantially equal to half a minimum length of the first section and diameters less than the diameter of the first section and in a ratio to each other from substantially ⅔ to substantially ⅞, and fourth, fifth and sixth sections having lengths substantially equal to ⅓ the minimum length of the first section and diameters less than the diameter of the third section and in ratios from substantially ¾ to ⅞ from one section to the next.

The candle primary source can also comprise a metal groove extending partly around the larger diameter first section of the dielectric candle, having a width from approximately ⅛ to approximately ⅙ the diameter of the first section and delimited by an outside edge longer than an inside edge of the groove.

BRIEF DESCRIPTION OF THE DRAWINGS

Other features and advantages of the invention will become apparent in the course of the following particular description of several preferred embodiments of the invention shown in the corresponding accompanying drawings, in which:

FIG. 11 is a diagrammatic perspective view showing a plane in which a primary source support of the antenna is developed;

FIG. 12 is a perspective view of the support mounted to rotate about its ends; and FIG. 12A is a detailed view of the circled portion of FIG. 12;

DESCRIPTION OF THE PREFERRED EMBODIMENTS

The telecommunication antennas in accordance with the invention described hereinafter are designed to function in a carrier frequency band above 1 GHz, for example, and in particular from about 10.5 GHz to about 14.5 GHz, to receive telecommunication beams transmitted by geostationary telecommunication satellites orbit close to the equator. The dimensions of the component parts of the receiver antenna are given hereinafter relative to a predetermined average wavelength $\lambda$ corresponding to the center frequency of a useful frequency band including the carrier frequencies transmitted by the satellite. The mean wavelength is typically equal to 2.5 cm and corresponds to a center carrier frequency of 12 GHz.

Figure 1:
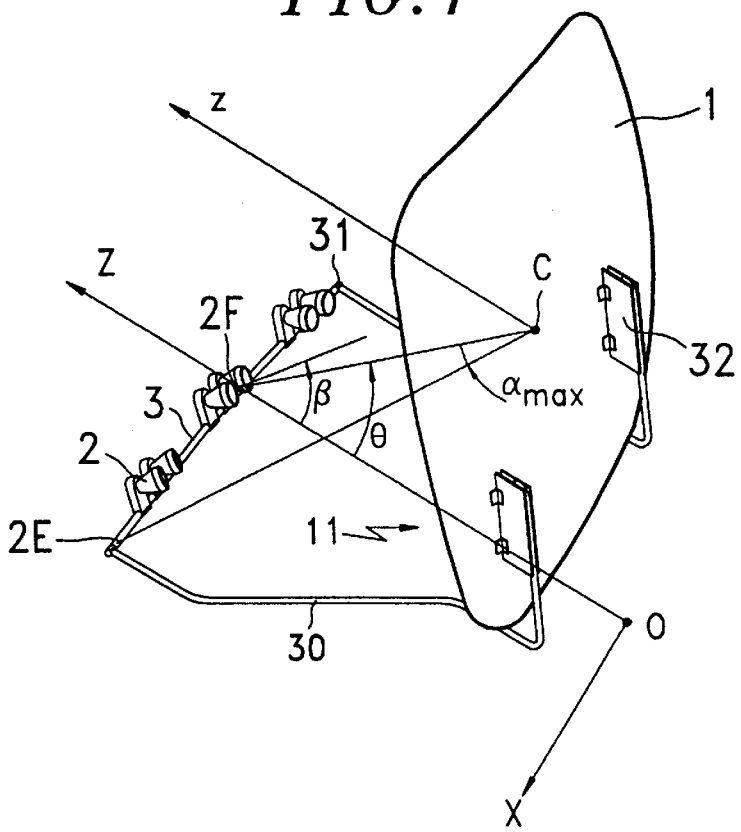
FIG. 1 is a perspective view of an antenna according to the invention.
Figure 2:
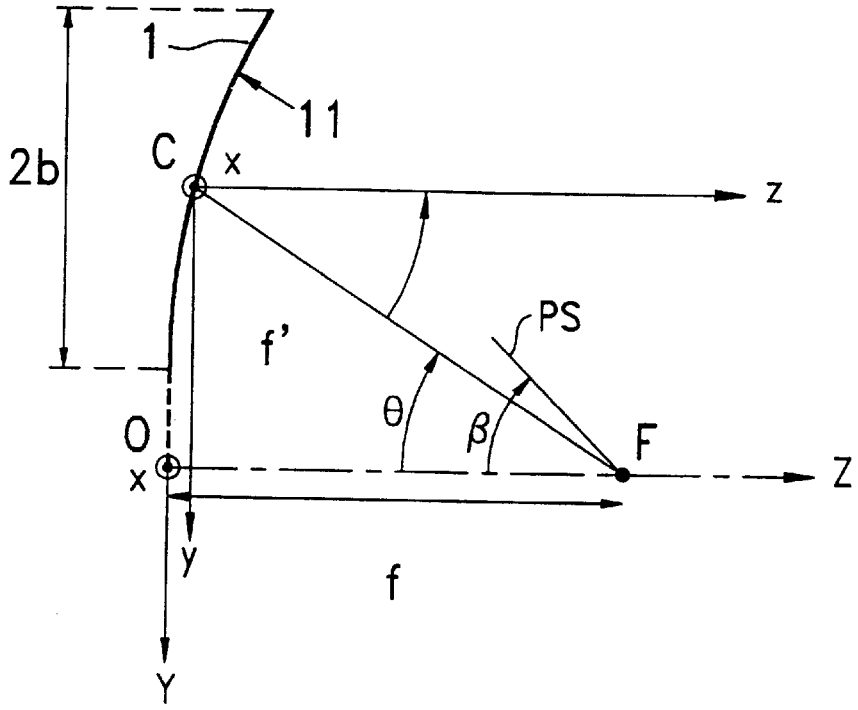
FIG. 2 is a side view of the reflector according to the invention relative to a system of axes of an initial paraboloid.

Referring to FIGS. 1 and 2, an antenna according to the invention essentially comprises a fixed reflector 1, a plurality of microwave primary sources 2 and a source support 3. The sources 2 are positioned on the support facing the concave reflecting surface 11 of the reflector 1 and along a plane and substantially circular focal line passing near a focus F and transversely to the focal line. The sources receive simultaneously beams from telecommunication or broadcast satellites spaced from each other by at most a few degrees, typically about three degrees, in the geostationary orbit within an antenna coverage angle $^{2\alpha}$max of at most approximately fifty degrees, i.e. a maximum depointing of the beams of approximately ±25°. For example, at most around fifteen primary sources 2 are positioned on the support 3 according to the position of fifteen respective satellites relative to the terrestrial position of the antenna.

The surface and the contour of the reflector 1 and the geometry of the source support 3 are designed to conform to the standard governing reception of broadcast satellite beams. In particular, the reflector has a maximum dimension less than 1 meter.

The concave reflecting surface 11 of the reflector 1 has a geometry represented by the following mathematical equation in a system of axes (C,x,y,z):

$$z(x,y)=z_p(x,y)+z_c(x,y)$$

The reflector conforming to the above equation is obtained by adding a correction surface $z_c(x,y)$ to an initial parabolic reflector derived from a circular section paraboloid with a horizontal axis of symmetry OZ and a focus F. After changing from the system of axes (O,X,Y,Z) to the system of axes C(x,y,z), such that X=x, $Y=y-f'\sin\theta$ and $Z=z+f-f'\cos\theta$, the equation of the paraboloid is written in the form of an offset paraboloid equation:

$$z_p(x,\ y)=\frac{1}{2f'(1+\cos\theta)}(x^2+y^2)-\frac{\sin\theta}{1+\cos\theta}y.$$

f is the geometrical focal length between the apex O of the initial paraboloid, coincident with the origin of the initial system of axes (O,X,Y,Z), and the geometrical focus F of the paraboloid and the reflector 1. f' is the equivalent focal length of the reflector between the center C of the aperture of the reflector and the geometrical focus F of the reflector. $\theta$ designates the offset angle of the reflector between the optical axis Cz of the reflector parallel to the axis OZ of the paraboloid and the segment CF of the equivalent focal length. The focal lengths f and f' are related by the following equation:

$$f=\frac{f'}{2}(1+\cos\theta).$$

In a preferred embodiment of the invention:

750 mm$\leqq$f'$\leqq$1.1 m, typically f'=940 mm, and

20°$\leqq\theta\leqq$30°, typically $\theta$=25.2°.

Figure 3:
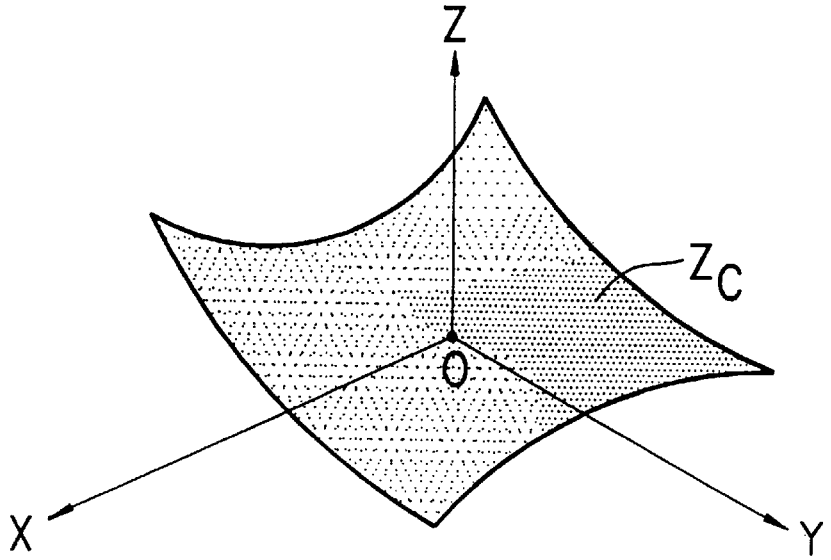
FIG. 3 is a perspective view relative to the initial paraboloid of a correction surface featuring in the equation of the reflector.

FIG. 3 shows the geometry of the correction surface $z_c(x,y)$ relative to the paraboloid and this geometry is described by a mathematical equation based on the interpolation of arcs of polynomial parametric curves ("splines") routinely used in mechanics to represent the flexing of thin plates.

Figure 4:
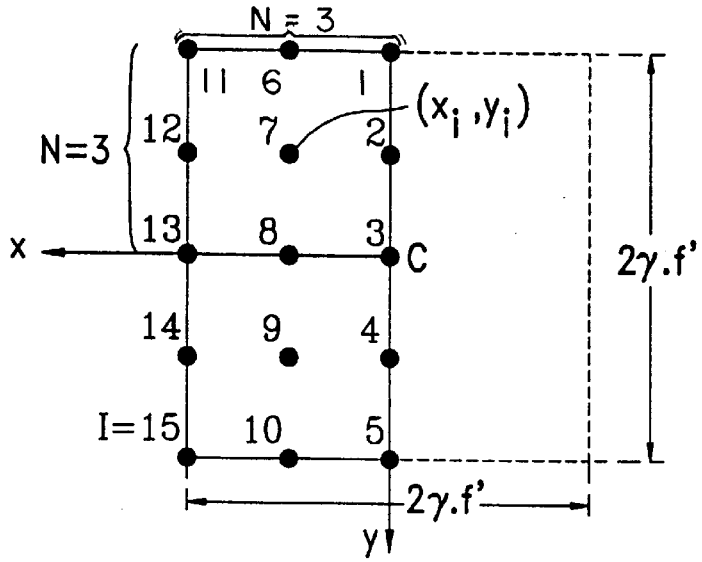
FIGS. 4 and 5 are graphs showing two examples of symmetrical grids of control points for interpolating the reflecting surface of the reflector.
Figure 5:
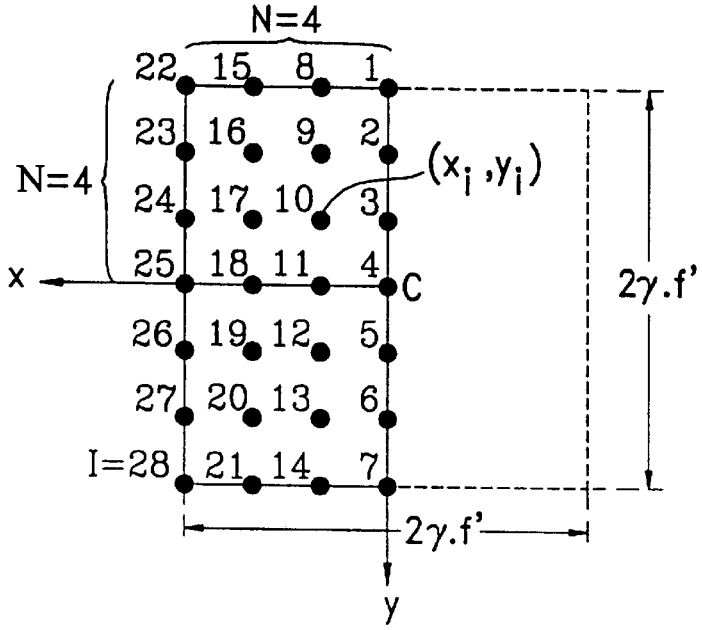

The reflecting surface 11 is symmetrical about the elevation plane yCz and is defined by interpolating control points disposed on a regular grid of rectangular meshes in one of the half-planes xCy of the aperture of the reflector delimited by the focal plane of symmetry yCz. The number of control points is N×N per quadrant in the system of axes xCy, where N is an integer not less than 2. For example, FIGS. 4 and 5 show grids with N=3 and N=4. The total number I of control points is N(2N−1).

The equation of the correction surface includes I+4 coefficients $a_1$ to $a_I$ and $b_1$ to $b_4$ and a dimensionless parameter $\gamma$ representing the normalized width of the interpolation domain relative to the equivalent focal length f'. The equation of the correction surface takes the following form:

$$z_c(x,\ y)=\sum_{i=1}^{i=I}\frac{a_i}{(\gamma\cdot f')^4}[r_i(x,\ y)]^5+\frac{b_1}{(\gamma\cdot f')}x^2+\frac{b_2}{(\gamma\cdot f')}y^2+b_3y+b_4\cdot\gamma\cdot f'$$

with $$r_i(x,y)=[(y-\gamma\cdot f'\cdot y_i)^2+(x-\gamma\cdot f'\cdot x_i)^2+(x+\gamma\cdot f'\cdot x_i)^2]^{1/2}$$

The variable $r_i(x,y)$ is a function of the distance $(y-\gamma\cdot f'\cdot y_i)^2+(x-\gamma\cdot f'\cdot x_i)^2$ between the projection of any point on the reflecting surface 11 with coordinates (x,y) onto the plane xCy and of one $(\gamma\cdot f\cdot x_i,\ \gamma\cdot f'\cdot y_i)$ of the N(2N−1) control points of the grid, within the product $\gamma f'$.

The I+4 coefficients of the correction surface $z_c(x,y)$ are calculated by solving a linear system of I+4 equations on the basis of the levels $z_i$ of the control points. The levels $z_i$ are unknowns which are obtained by means of the following two separate steps.

In a first step, approximate values of $z_i$ are calculated using an analytical formula based on a decomposition into Taylor series of aberrations such as stigmatism and aplanetism. The Taylor series is of the sixth order to achieve sufficient accuracy in determining the level z. The equation obtained for the correction surface is parameterable as a function of the position of an end primary source 2E with coordinates $(x_E,y_E,z_E)$ which is the most offset along the circular support 3 relative to the plane of symmetry yCz, and as a function of the maximum aperture angle $\alpha$max of the antenna, equal to the angle of defocusing of the end source, as shown in FIG. 1. That equation takes the following form:

$$P(x_i,\ y_i,\ z_i(x_i,\ y_i)) = \sum_{n=0}^{5}\sum_{m=0}^{10}\sum_{p=0}^{10} a_{n,m,p}(x_E,\ y_E,\ z_E,\ \alpha_{\max})x_i^{2n}y_i^m z_i^p = 0$$

The coefficients $a_{n,m,p}$ are expressed in polynomial form as a function of $(x_E,y_E,z_E)$ and $\alpha$max and the values of $z_i$ associated with the pair $(x_i,y_i)$ are obtained by seeking the only real and physical root of the equation $P(x_i,y_i,z_i)=0$.

The above equation has only a non-optimum approximate solution.

In a second step, from the points $(x_i,y_i,z_i)$ calculated above, the initial surface is generated in the form of the aforementioned second order polynomial equation $z_c(x,y)$. A hybrid optimization process based on a genetic algorithm coupled to a gradient method adjusts and optimizes the values of the levels $z_i$ in a manner that simultaneously satisfies the following conditions:

- stabilization of the directivity over all of the field of view of the reflector,
- conformance to the characteristics of standardized radio beams, such as the diagrams,
- exact pointing of all the beams at the geostationary orbit, and more particularly of three beams corresponding to the two end sources defocused to $\pm\alpha$max and a center source 2F centered at the focus F with $\alpha$=0; and
- stabilization of performances over the useful frequency band, in particular of the gain relative to the end sources and the center source.

After several tens of successive iterations, the coefficients of the equation of the correction surface $z_c$ are deduced.

The angular range of coverage of the antenna depends on the parameter $\gamma$ which defines a family of reflecting surfaces. The invention is therefore concerned with a set of reflecting surfaces having similar shapes and substantially identical radio performance. As $\gamma$ increases, the field of view of the reflector decreases and evolves progressively toward the performance of the parabolic reflector beyond $\gamma$=0.65 about. As $\gamma$ decreases, the field of view increases; below a threshold in the order of 0.5, the average efficiency of the reflector decreases excessively, causing high directional errors between the center beam and the most offset end beam. A value of $\gamma$ close to 0.54 or 0.55 is recommended to assure a coverage $^{2\alpha}$max of approximately fifty degrees.

For example, the specific coefficients in the equation defining the correction surface $z_c(x,y)$ included in the equation of the reflecting surface 11 of the reflector 1 are indicated in the table below for N=4 and I=28.

| I | $x_i$ | $y_i$ | $a_i$ | $b_i$ |
|---|---|---|---|---|
| 1 | 0.0000 | −1.0000 | 0.0217 | 0.01094 |
| 2 | 0.0000 | −0.6667 | −0.0212 | −0.00254 |
| 3 | 0.0000 | −0.3333 | 0.0922 | 0.02793 |
| 4 | 0.0000 | 0.0000 | −0.1789 | −0.0189 |
| 5 | 0.0000 | 0.3333 | 0.1232 | |
| 6 | 0.0000 | 0.6667 | 0.0223 | |
| 7 | 0.0000 | 1.0000 | −0.0101 | |
| 8 | 0.3333 | −1.0000 | −0.0025 | |
| 9 | 0.3333 | −0.6667 | 0.0494 | |
| 10 | 0.3333 | −0.3333 | 0.0311 | |
| 11 | 0.3333 | 0.0000 | 0.0471 | |
| 12 | 0.3333 | 0.3333 | −0.0288 | |
| 13 | 0.3333 | 0.6667 | −0.0225 | |
| 14 | 0.3333 | 1.0000 | 0.0198 | |
| 15 | 0.6667 | −1.0000 | −0.0019 | |
| 16 | 0.6667 | −0.6667 | −0.00052 | |
| 17 | 0.6667 | −0.3333 | 0.00024 | |
| 18 | 0.6667 | 0.0000 | 0.0014 | |
| 19 | 0.6667 | 0.3333 | 0.00094 | |
| 20 | 0.6667 | 0.6667 | 0.00041 | |
| 21 | 0.6667 | 1.0000 | −0.00034 | |
| 22 | 1.0000 | −1.0000 | 0.00024 | |
| 23 | 1.0000 | −0.6667 | 0.00029 | |
| 24 | 1.0000 | −0.3333 | 0.000091 | |
| 25 | 1.0000 | 0.0000 | −0.00004 | |
| 26 | 1.0000 | 0.3333 | −0.000067 | |
| 27 | 1.0000 | 0.6667 | −0.00012 | |
| 28 | 1.0000 | 1.0000 | 0.00009 | |

Figure 6:
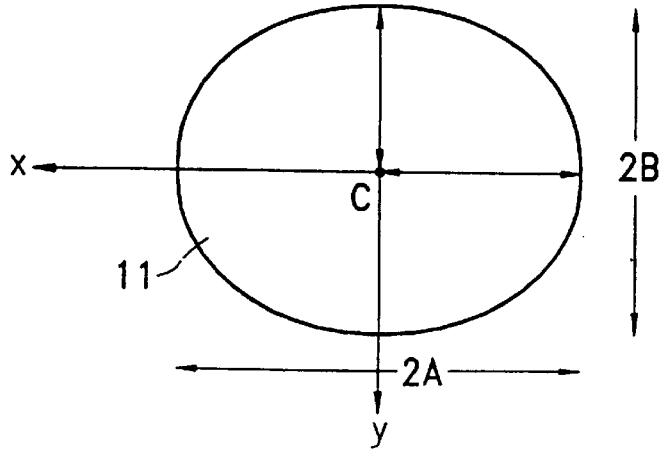
FIG. 6 is a front view of the reflecting surface of the reflector with a preferred contour.

The outline of the reflecting surface 11 of the reflector, whose projection along the axis Cz onto the plane xCy is shown in FIG. 6, is not necessarily circular or elliptical. It is generally of "superquadratic" shape with the following cartesian equation:

$$\left[\frac{x}{A}\right]^{2\nu} + \left[\frac{y}{B}\right]^{2\nu} = 1$$

A denotes the half-axis of the reflector along the azimuth axis x, B designates the half-axis of the reflector along the elevation axis y of the offset direction of the reflector, and $\nu$ is a positive real number defined below. Referring to FIGS. 4 and 5, the maximum dimension 2A of the aperture of the reflector is less than the side of the square whose value is $2\gamma f'$ typically equal to approximately 103.5 cm.

The parameters defining this curve are optimized to minimize the overall size of the reflector and to maintain the ratio (equivalent focal length f'/the maximum dimension 2A) at a value less than 1. Their respective values are indicated below by way of example:

$A/\lambda \leqq 20$, $1.3 \leqq A/B \leqq 1.4$, $1.0 \leqq \nu \leqq 3$, $\lambda$ is the wavelength corresponding to the center frequency of the frequency band.

The parameters A and $\nu$ are chosen so that the reflector 1 conforms to national rules concerning the installation of individual satellite receiver antennas, i.e. has a maximum dimension 2A less than 98 cm for the Ku band in France. Those parameters are also used to adjust the area and therefore the gain of the reflector according to the intended application.

However, the shape of the contour of the reflecting surface can be significantly modified to improve the esthetics of the reflector without degrading its performance.

Figure 7:
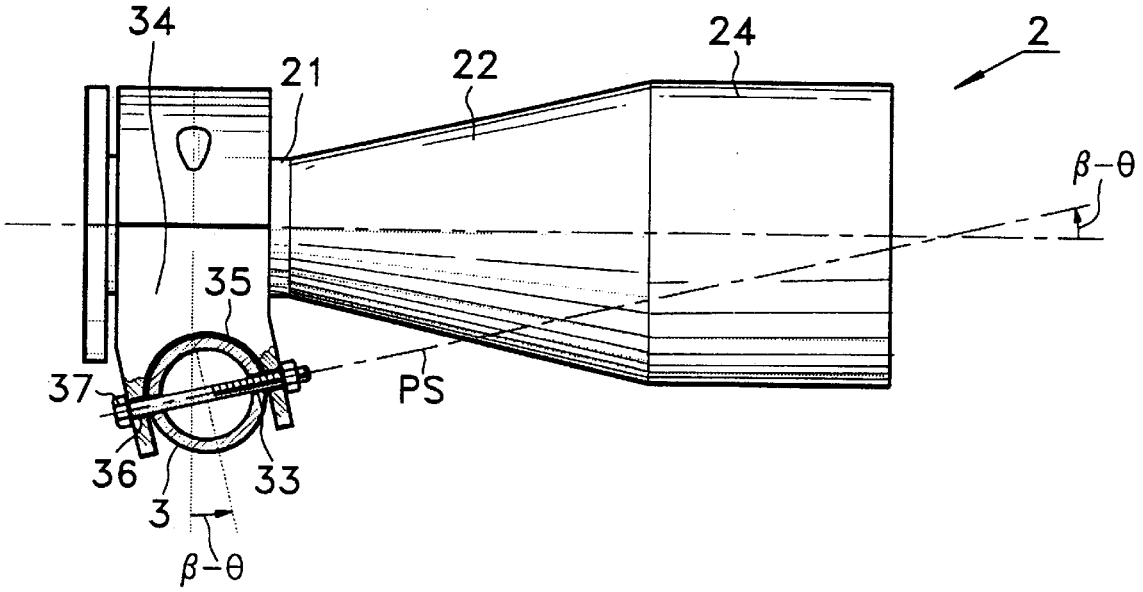
FIG. 7 is a side view of a first embodiment primary of a source, in the form of a horn with a fixing collar.
Figure 8:
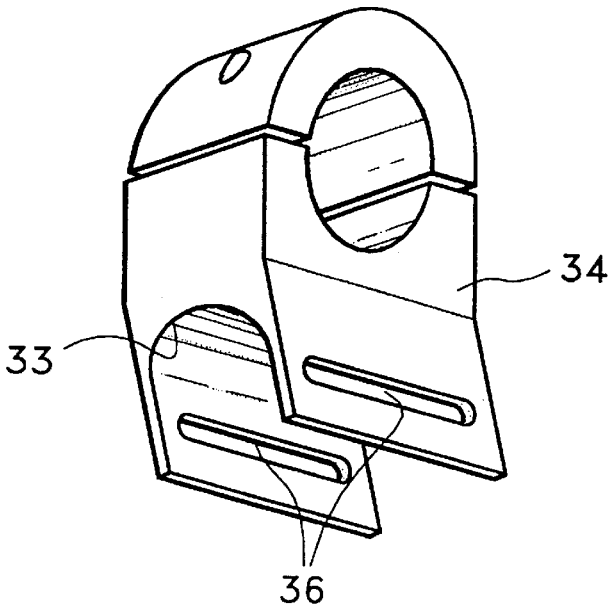
FIG. 8 is a perspective view of the fixing collar.
Figure 9:
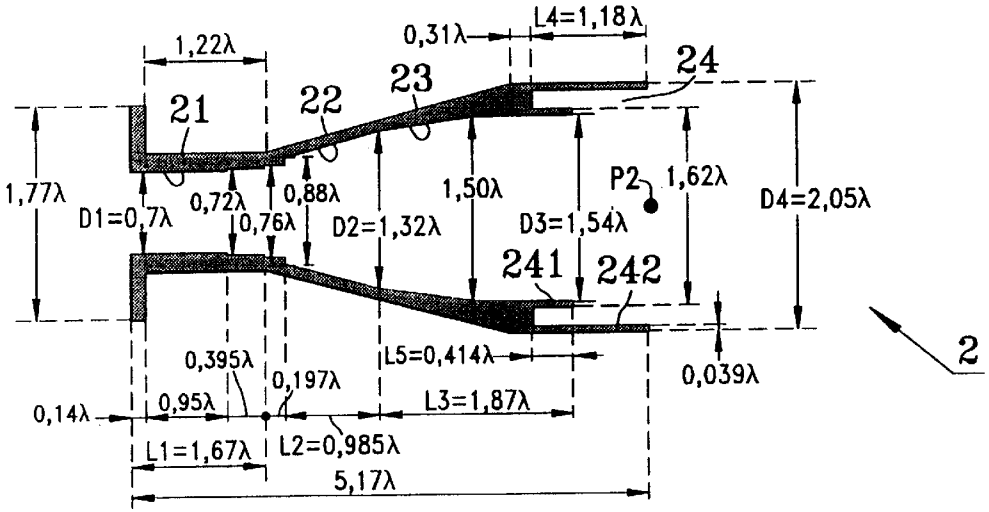
FIG. 9 is a view of the horn primary source in axial section.

In a first embodiment, each of the primary sources 2 comprises a horn having a cylindrical rear section 21, a frustoconical intermediate section 22, a frustoconical front section 23 and a circular facial groove 24, as shown in FIGS. 7 and 9.

Exact geometrical dimensions of one preferred embodiment of the horn 2 are indicated in the cross section view shown in FIG. 9. All the dimensions are normalized to the wavelength λ corresponding to the center frequency of the useful frequency band.

If L1, typically equal to 1.67 λ, designates the minimum length of the frustoconical intermediate section 21, the lengths L2 and L3 of the other two sections 22 and 23 are substantially greater than L½ and substantially greater than L1, i.e. L3 is substantially equal to 2L2. For an average diameter D1, typically equal to 0.7 λ, of the rear section 21 which is separated from the smaller base of the intermediate section 22 by three shoulders, the diameters D2 and D3 of the larger bases of the frustoconical sections 22 and 23 are respectively substantially less than 2 D1 and substantially greater than 2 D1.

The groove 24 is located at the perimeter of the larger base of the frustoconical front section 23 and aligned therewith. It contributes to flattening the wave plane at the exit from the horn and therefore to improving the directionality of the horn for a bandwidth of approximately 4 GHz, in which the horn has an average gain of the order of 15 dBi. The groove has an outside edge 241 of length L4 between L2 and 1.5(L2), an inside edge 242 of length L5 substantially less than L⅔, an outside diameter D4=2.05 λ substantially equal to 3 D1, i.e. a groove width substantially equal to D⅜, and an inside diameter substantially equal to D3, i.e. 1.62 λ.

For comparable radio performances to a conventional horn, the inside profile of the horn 2 of the invention makes it more compact and achieves an angular separation of 3° between consecutive beams by ensuring a low value of the ratio f'/2A of the reflector less than one. This profile also minimizes the cost of molding the horn.

Figure 10:
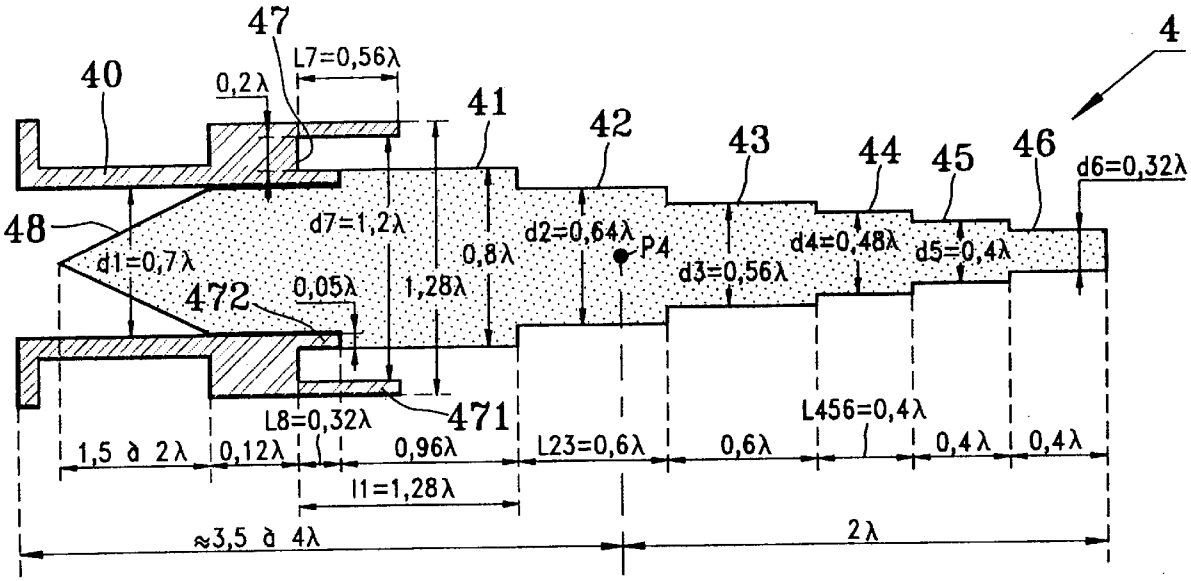
FIG. 10 is a view of a second embodiment of a primary source, in the form of a candle.

In a second embodiment, a primary source is a dielectric source 4 referred to as a "candle" or "cigar" for which precise geometrical dimensions are indicated in FIG. 10 in the case of one preferred example. The candle source 4 also has an average gain of the order of 15 dBi in the 4 GHz band and offers a displacement of the phase center P4 of the order of one centimeter for a frequency bandwidth of approximately 4 GHz to compensate chromatic aberration of the reflector.

The candle source 4 includes a dielectric "candle" made up of cylindrical sections whose diameters decrease from a rear end toward a front end facing the reflector. The sections are a rear cylindrical section 41, part of which is contained within a monomode metal guide 40, projecting to a minimum length ζ1≅1.28 λ and having a diameter d1 of approximately 0.7 λ to 0.8 λ, two intermediate cylindrical sections 42 and 43 of length L23 equal to approximately 0.6 λ and with respective diameters d2≅(¾)d1≅0.64 λ and d3≅(⅞) d2≅0.56 λ and three front sections 44, 45 and 46 which are thinner and have a length L456 equal to approximately (⅔)L23≅0.4 λ and respective diameters d4≅(¾)d2≅0.48 λ, d5≅(⅔)d2≅0.40 λ and d6≅(½)d2≅0.32 λ. The dielectric has a low relative permittivity, close to 2; it is, for example, a rigid low-density foam, with a fine closed-cell texture, and preferably has a permittivity lying between 1.7 and 1.9.

The source 4 also includes a metal facial groove 47 in the metal guide 40 extending around the rear part of the rear section of the dielectric candle 47 and having an outside diameter d7≅3/2 d1≅1.2 λ. An outside dimension 471 of the groove 47 has a length L7≅ζ½≅0.56 λ greater than the length L8≅ζ¼≅0.32 λ of an inside dimension 472 of the groove. The groove therefore has a width from approximately (⅛)d1 to approximately (⅙)d1.

In other embodiments the waveguide 40 is entirely filled with dielectric or has an impedance matching cone 48 whose length is from 1.5 λ to 2.5 λ in order to provide the transition from the dielectric candle to the empty waveguide.

Compared to the horn type primary source 2, for the same focal length f or f' the candle source 4 has a diameter at least 25% less and can therefore provide an angular separation of beams of approximately 2°. For the same angular separation of the beams, the focal length f or f' of the reflector is reduced approximately 20% if the primary source is a candle source whose dielectric filling the waveguide 40 has a low permittivity and low loss.

The support 3 is a toroidal tube whose circular arc axis SS has a center CS separate from the center C of the reflecting surface 11, as shown in FIG. 11. The circular arc axis SS passes significantly below the focus F of the reflector, at which the phase center P2 (or P4, FIG. 10) of a center primary source 2F in the vertical plane of symmetry yCz of the reflector is exactly positioned, and lies in a plane PS whose inclination β relative to the horizontal plane XOZ is fixed by the latitude L of the antenna, as shown in FIGS. 1 and 11.

The inclination β differs from the offset angle θ of the reflector and is expressed as a function thereof and of the latitude L of the antenna by the following logarithmic law:

$$\beta = (18.3)\cdot \mathrm{Log}_{10}(\theta - 18.9) + \theta + \frac{L}{6} - 9,$$

L and θ are angles expressed in degrees.

The radius R of the axis of the circular support 3 is deduced from the following equation:

$$R = \frac{f' \cdot \cos\theta}{\cos(\beta - (L/6 - 9))}.$$

The radius R of the support is preferably from about 1 m to about 1.2 m and the inclination β is preferably from about 35° to about 40° for an offset angle θ of 25°. For example, for a latitude L=45° the inclination β is 38.3° and the radius R is 1.1 m.

The inclination β of the support plane PS separate from the focal plane xCF is chosen according to the latitude L of the antenna so that the sources 2, 4 mounted on the support can be pointed optimally along a focal line (see FIG. 13) corresponding to the geostationary orbits of the target satellites. This inclination β is adjusted to within ±5° by rotating the support 3 about first ends 31 of the arms 30, as shown in FIG. 12.

For example, the support 3 is a light metal tube with a section equal to 20 mm and is curved to a circular shape. It is immobilized relative to the reflector 1 by two cranked side arms 30 which have first ends 31 articulated to the ends of the support (FIG. 12) and second ends 32 nested in brackets fixed against the convex rear face of the reflector (FIG. 11).

The support 3 has regularly spaced diametral holes 33 through it for selectively fixing cranked fixing collars 34 of the primary sources 2 or 4, as shown in FIG. 7. Each fixing collar is clamped onto the rear waveguide 21, 40 of a primary source 2, 4 and has a groove 35 with a semicylindrical bottom to receive the support 3. Two diametrally opposed longitudinal slideways 36 are made in the sides of the grooves 35 and receive a screwthreaded clamping rod 37 passing through a hole 33 in the source support to enable the collar 34 with the primary source 2, 4 to slide on the support 3 and position the primary source to point continuously to the geostationary orbit.

The fixing collars 34 are oriented at an angle β−θ to the plane of symmetry PS of the support in order to point the sources toward the center C of the reflector, as shown in FIGS. 2 and 12. The angle $\beta-\theta$ remains the same regardless of the lateral displacement of the source along the support and is from about 10° to about 20°. With an antenna latitude L of 45° the angle $\beta-\theta$ is 13.1°.

If the antenna is installed at a latitude other than from 30° to 60°, the plane PS of the support 3 has an inclination $\beta$ from 35° for regions near the equator to 55° for regions near the North Pole. The angle $\beta-\theta$ changes in the opposite direction so that the angle difference $\beta-(\beta-\theta)=\theta$ equal to the offset angle is from 20° to 30°.

The geometry of the support 3 of the sources 2, 4 is drastically simplified to reduce its cost and to facilitate the installation of the sources through fast and easy pointing to the required satellites. This intrinsic property is obtained only by varying the set of coefficients $a_i$ and $b_i$ associated with the very particular choice of the parameters $\beta-\theta$, $\beta$ and R, which are used to define the geometry of the support. However, other types of support can be used, as described in U.S. Pat. No. 5,283,591 and French Patent 2,701,169.

Figure 13:
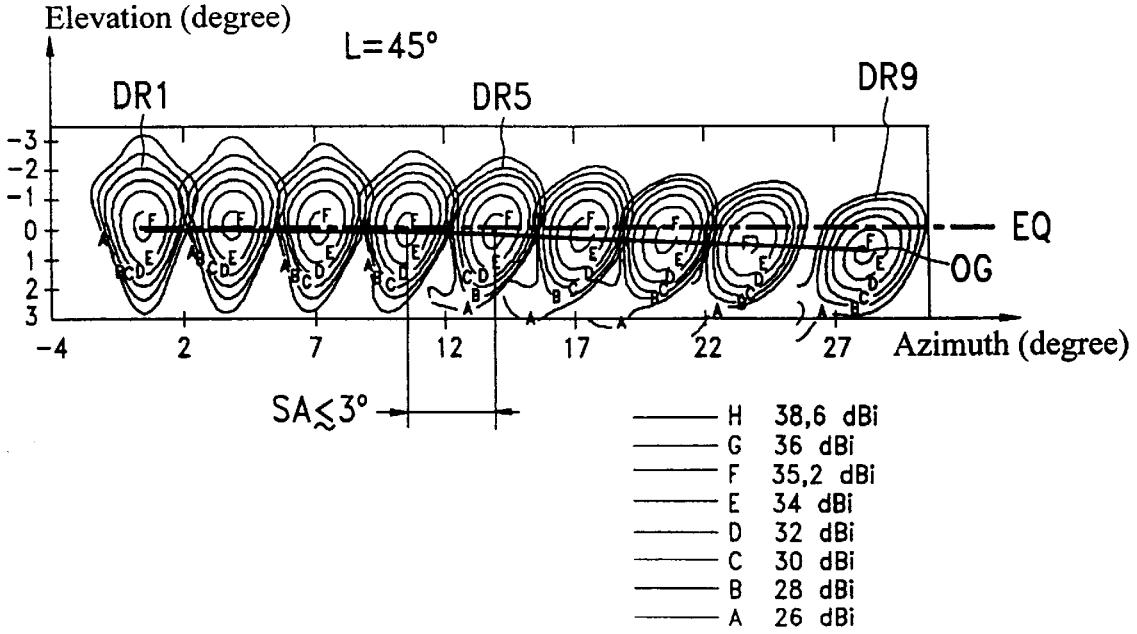
FIG. 13 shows radiation diagrams of radioelectric beams picked up by primary sources of the antenna according to the invention.

The advantages of the antenna of the invention pointed toward the geostationary satellites are illustrated in FIG. 13 by nine radiation diagrams DR1 to DR9 represented by level lines and corresponding to nine radioelectric beams from satellites positioned along the geostationary orbit that can be received by nine primary sources 2, 4 juxtaposed on the support 3 of the antenna, which is at an average latitude of 45°.

The separation SA between the beams is approximately 3° and the maximum of each beam coincides perfectly with the geostationary orbit OG over an angular range exceeding 55° ([−27.5°, 27.5°]). If the antenna is installed in a region far from the equator EQ, the beams are no longer aligned. Because the distance from the equator EQ is not negligible, it is essential to take these corrections into account but to preserve a single degree of freedom for the positioning of the primary sources. The antenna constituting the preferred embodiment of the invention is designed to operate at latitudes around 45°, i.e. at latitudes from about 30° to about 60°, without it being necessary to add to the positioning of the primary sources adjustments in elevation, i.e. adjustments of the angle $\beta-\theta$ or the angle $\beta$.

The antenna is distinguished by the following points:

- the specific conformation of the reflector and the support provides the possibility of rigorously tracking beams non-aligned on the geostationary orbit by simple guided translatory movement of the primary sources along a support without adding adjustments in elevation (only one degree of freedom);
- simplification of the focal line of the antenna, which is now perfectly plane and circular;
- angular separation between consecutive beams of approximately 3° with horn sources 2 or approximately 2° with candle sources 4, obtained with a compact reflector, i.e. a reflector having a focal length/diameter ratio less than one, thanks in particular to the compactness and the directivity of the specific primary sources;
- the radiation characteristics of each beam conform to standardized copolar and contrapolar specifications;
- the average efficiency of the antenna remains high, of the order of 45%, for a scanning angle range greater than 50°;
- a very wide bandwidth in the order of 35% (10.5 GHz to 14.5 GHz);
- antenna geometrical dimensions contained within a 1 $m^3$ cube;
- compatibility of the antenna with a positioner using a polar mount.

The antenna of the invention is reproducible for uses other than multisatellite reception in the Ku band. Parametering all dimensions of the antenna as a function of frequency extends the field of the invention to multimedia applications.

The antenna according to the invention can be used:

- to receive a plurality of beams from satellites in geostationary orbit;
- to receive from and/or to transmit to the geostationary orbit; and
- with electrically driven displacement of a single primary source in front of the reflector, as described for moving a microwave head, for example, in U.S. Pat. No. 5,283,591 and French Patent 2,701,169.

What is claimed is:

1. An antenna comprising a reflector for telecommunication satellite beams having a continuous concave reflecting surface whose equation is deduced from the equation of an offset paraboloid having a focus and an offset angle by adding thereto the equation of a correction surface and which is symmetrical about a focal plane of symmetry of the paraboloid, wherein the equation of the correction surface comprises a second order polynomial in two coordinates relative to axes perpendicular to the axis of symmetry of the paraboloid and a sum of N(2N−1) terms depending in particular on distances between the projection of any point on the reflecting surface onto a plane perpendicular to said focal plane of symmetry and N(2N−1) control points of a grid extending over said perpendicular plane and limited by said focal plane of symmetry, where N is an integer not less than 2.

2. The antenna claimed in claim 1 wherein most terms of said equation of said correction surface have a coefficient depending on the focal distance between said paraboloid focus and a center of said reflecting surface and on a dimensionless parameter which is a function of a field of view of said reflector.

3. The antenna claimed in claim 1 wherein said equation of said correcting surface is:

$$z_c(x,\ y)=\sum_{i=1}^{i=I}\frac{a_i}{(\gamma\cdot f')^4}[r_i(x,\ y)]^5+\frac{b_1}{(\gamma\cdot f')}x^2+\frac{b_2}{(\gamma\cdot f')}y^2+b_3y+b_4\cdot\gamma\cdot f'$$

with $$r_i(x,y)=[(y-\gamma\cdot f'\cdot y_i)^2+(x-\gamma\cdot f'\cdot x_i)^2+(x+\gamma\cdot f'\cdot x_i)^2]^{1/2}$$

where x, y and z are coordinates of any point on said reflecting surface and $x_i$, $y_i$ are coordinates of a control point of said grid in said perpendicular plane, $a_i$ and $b_1$ to $b_4$ are predetermined coefficients, $\gamma$ is a dimensionless parameter, and f' is a focal distance between said paraboloid focus and a center of said reflecting surface.

4. The antenna claimed in claim 3 wherein said dimensionless parameter is of the order of 0.55.

5. The antenna claimed in claim 1 wherein a focal distance between said paraboloid focus and a center of said reflecting surface lies between 30 times and 45 times a average wavelength of said satellite beams and said offset angle between said axis of said paraboloid and a segment joining said paraboloid focus to a center of said reflecting surface lies between about 20° and about 30°.

6. The antenna as claimed in claim 1 further comprising a circular arc shape support for supporting primary sources oriented toward the center of said reflecting surface, said circular arc shape support lying in a support plane and positioned so that a source in said focal plane of symmetry has a phase center coinciding substantially with said paraboloid focus, said support plane having an inclination to said axis of said paraboloid greater than the offset angle between said axis of said paraboloid and a segment joining said paraboloid focus to a center of said reflecting surface.

7. The antenna claimed in claim 6 wherein said inclination of said support plane depends on a logarithmic function of said offset angle and a linear function of the latitude of said antenna.

8. The antenna claimed in claim 6 wherein the difference between said inclination of said support plane and said offset angle is from approximately 10° to approximately 20°.

9. The antenna claimed in claim 6 wherein said support has a radius which is proportional to a focal distance between said paraboloid focus and a center of said reflecting surface and which depends on a trigonometric function of said inclination of said support plane and said offset angle.

10. The antenna claimed in claim 6 wherein said support is rotatably mounted about an axis fixed relative to said reflector and passing through ends of said support.

11. The antenna claimed in claim 1 comprising at least two primary sources having an angular radiation separation not greater than approximately 3°.

12. The antenna claimed in claim 1 comprising at least one horn primary source having a cylindrical rear section, a frustoconical intermediate section whose larger base diameter is substantially less than twice an average diameter of the rear section, and a frustoconical front section whose length is substantially greater than twice the length of said intermediate section and whose larger base diameter is substantially equal to twice said average diameter of said rear section.

13. The antenna claimed in claim 12 wherein said horn primary source has a facial groove situated at the periphery of the larger base of said frustoconical front section, having a width substantially equal to ⅛ the diameter of a larger base of said front section, and delimited by an outside edge longer than an inside edge of said groove.

14. The antenna claimed in claim 1 comprising at least one dielectric candle primary source.

15. The antenna claimed in claim 14 wherein the dielectric candle source comprises a dielectric candle having first, second and third cylindrical sections of substantially identical length and diameters decreasing from one section to the next from a rear end toward a front end of said dielectric candle source in ratios from approximately ¾ to approximately 9/16 and from approximately ½ to approximately ⅔.

16. The antenna claimed in claim 15 wherein said candle primary source comprises a metal groove extending partly around the said first section of said dielectric candle, having a width from approximately ⅛ to approximately ⅙ the diameter of said first section and delimited by an outside edge longer than an inside edge of said groove.

17. The antenna claimed in claim 14 wherein said dielectric candle source comprises a dielectric candle having a cylindrical first section, second and third sections having lengths substantially equal to half a minimum length of said first section and diameters less than the diameter of said first section and in a ratio to each other from substantially ⅔ to substantially ⅞, and fourth, fifth and sixth sections having lengths substantially equal to ⅓ said minimum length of said first section and diameters less than the diameter of said third section and in ratios from substantially ¾ to ⅞ from one section to the next.

* * * * *